United States Patent [19]

Cheng

[11] 4,286,752

[45] Sep. 1, 1981

[54] NESTING TRACK SECTION FOR MODEL VEHICLES

[76] Inventor: Richard C. M. Cheng, 1001 Genter St., La Jolla, Calif. 92037

[21] Appl. No.: 97,654

[22] Filed: Nov. 27, 1979

Related U.S. Application Data

[63] Continuation of Ser. No. 857,503, Dec. 5, 1977, Pat. No. 4,231,517.

[51] Int. Cl.[3] ..... E01B 23/00; A63H 19/28

[52] U.S. Cl. ..... 238/10 F; 46/1 K; 220/23.6; 280/33.99 T

[58] Field of Search ..... 220/23.6; 280/33.99 T; 238/10 F, 10 R; 46/1 K

[56] References Cited

U.S. PATENT DOCUMENTS 3,841,339 10/1974 Fox et al. ..... 220/23.6

4,091,995 5/1978 Barlow et al. ..... 238/10 F 4,106,695 8/1978 Carella et al. ..... 238/10 F

*Primary Examiner*—Richard A. Bertsch

*Attorney, Agent, or Firm*—Robert K. Youtie

[57] ABSTRACT

A model track section including a bed of generally rectangular cross-sectional outline, and a vertical wall of rectangular cross section on each side edge of the bed arranged with the lower edge of each wall spaced above the underside of the bed to define a rectangular recess configured to conformably receive a wall of a like track section with the underside of the bed substantially engaging the bed of the like track section. This enables a substantially complete nesting relationship between superposed sections with the outer sides of the section walls defining vertical sides for conforming engagement of adjacent stacks of nesting sections.

1 Claim, 4 Drawing Figures

FIG. 3
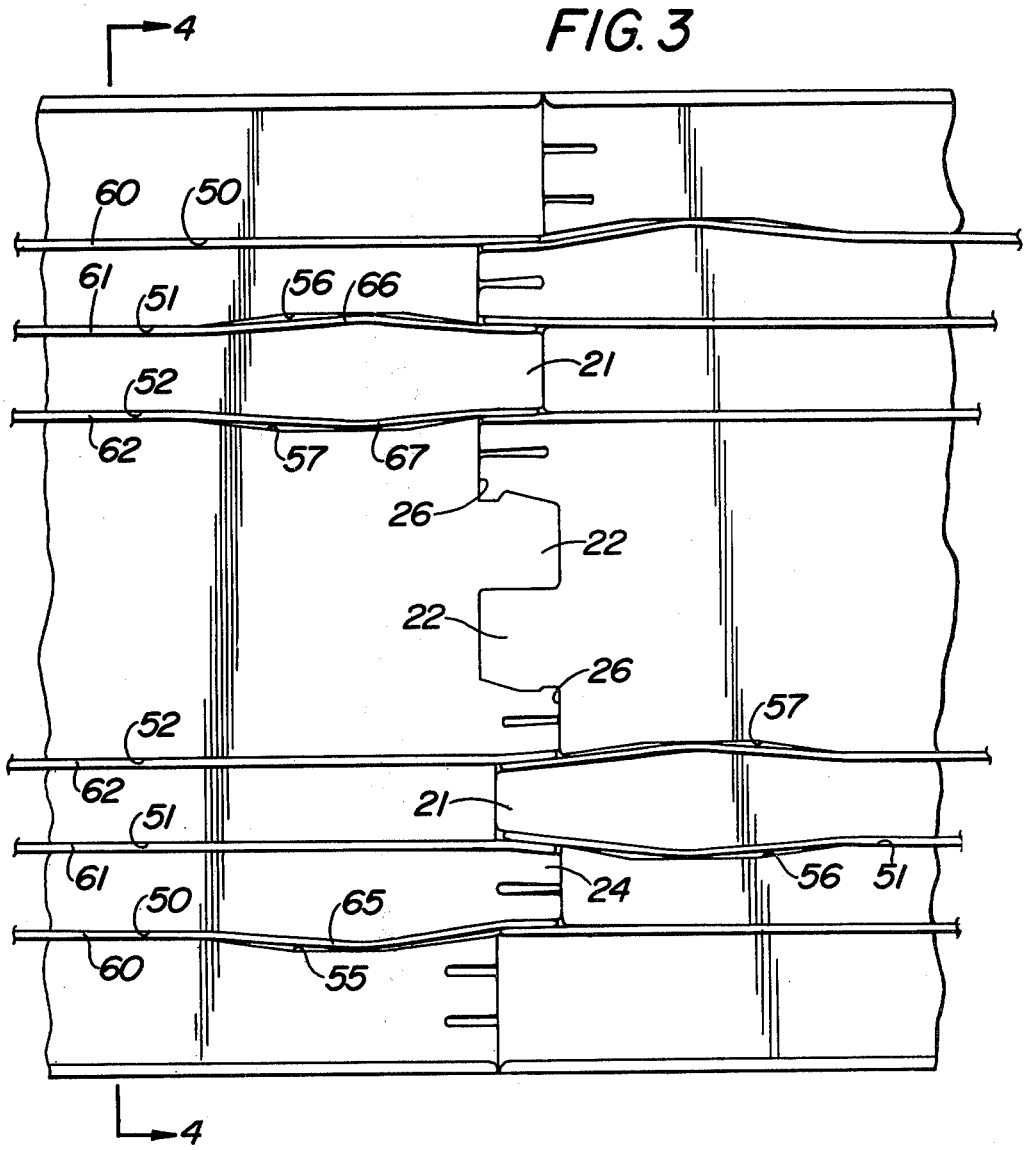
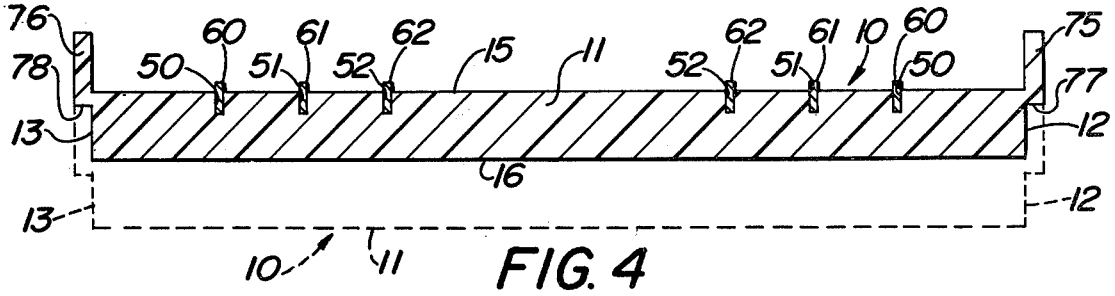
FIG. 4

NESTING TRACK SECTION FOR MODEL VEHICLES

CROSS REFERENCES TO RELATED APPLICATIONS

This application is a continuation of my copending patent application Ser. No. 857,503 filed Dec. 5, 1977 entitled Track Section For Model Vehicles now U.S. Pat. No. 4,231,517 issued Nov. 4, 1980.

BACKGROUND OF THE INVENTION

In the distribution of model track sections, competition is extremely keen so that manufacture may be performed in foreign countries at remote distances if economically warranted by savings in manufacture plus costs involved in shipping. Shipping has heretofore been a serious problem to foreign manufacturers of model track sections. In particular, shipping costs have been high due to lost space due to irregular or nonconforming shapes, resulting in "shipping air". Further, the frequency of damage, also due to irregular or nonconforming shapes, has been high and required expensive protective packing.

SUMMARY OF THE INVENTION

Accordingly, it is an important object of the present invention to provide model track sections for model racing vehicles which are uniquely well adapted for substantially complete nesting to effectively protect themselves from damage in handling and shipment, reduce space requirements to a minimum for economy in storage and shipment, and require minimum materials for effecting substantial savings in manufacture.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 3 is a plan view showing the track section end portions of FIG. 1 in an assembled condition.

FIG. 4 is a sectional view taken generally along the line 4—4 of FIG. 3, and showing in phantom an additional like track section in a nested condition for storage or transit.

DESCRIPTION OF THE PREFERRED EMBODIMENTS

Figure 1:
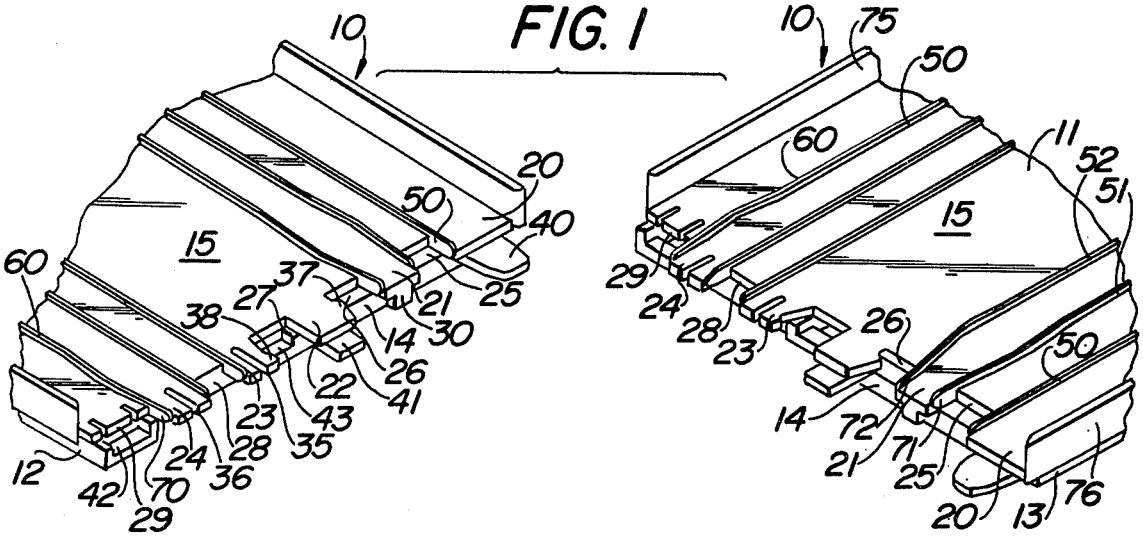
FIG. 1 is a top perspective view showing end portions of like track sections adapated for assembly and disassembly in accordance with the teachings of the present invention.
Figure 2:
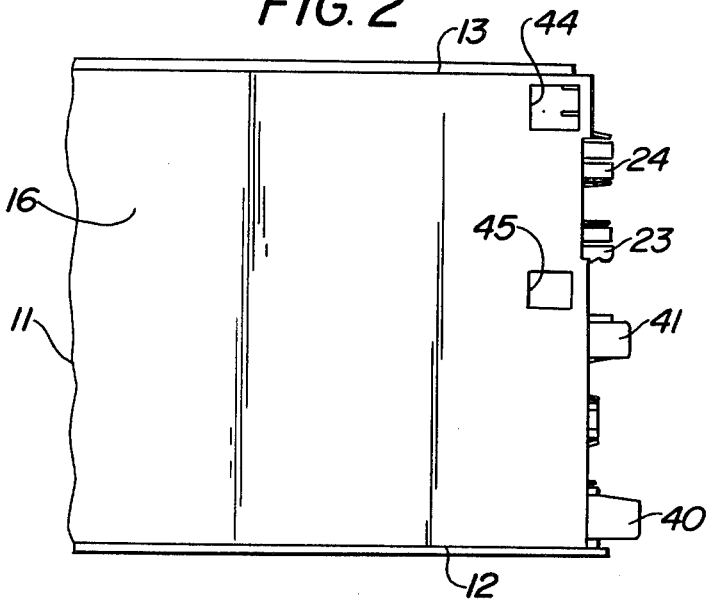
FIG. 2 is a bottom plan view of one of the track section end portions of FIG. 1.

Referring now to FIGS. 1 and 2, a pair of like track sections are each generally designated 10 in FIG. 1, and may each include a generally flat base plate or bed 11. While the track sections 10 of the illustrated embodiment are shown as straight, it is appreciated that suitably nonstraight or curved track sections may be constructed in accordance with the teachings of the present invention. The bed 11 of each track section 10 includes a pair of parallel spaced longitudinally extending side edges 12 and 13, and a pair of opposite end edges 14, each extending generally normal to and between the adjacent pair of ends of side edges 12 and 13. The bed 11 may further include a generally flat upper surface 15 extending between the side edges 12 and 13, and end edges 14. Also, the lower or under surface 16 of bed 11 may be generally flat, and similarly extend between the side and end edges 12, 13 and 14.

Each end edge 14 is formed with a plurality of laterally spaced longitudinally extending projections, as at 20, 21, 22, 23 and 24. The end projections 20–24 are all substantially flush with the upper bed surface 15, and above or spaced from the lower or under bed surface 16. The projection 20 may have one side generally flush with the adjacent bed side edge 13, and is spaced from the next adjacent end projection 21 by an intermediate recess 25. The projection 22 is similarly spaced laterally from the projection 21 by a recess 26 between the projections 21 and 22, and similarly a recess 27 is defined by the space between next adjacent end projection 23 and end projection 22. The end projection 24 is similarly spaced from the projection 23 by an intermediate recess 28, while the space between projection 24 and adjacent side edge 12 may be considered, as a recess, as at 29. The recesses 25, 26, 27, 28 and 29 serve to respectively receive projections 24, 23, 22, 21 and 20, upon end to end aligned digitally interfitting engagement, as in the condition shown in FIG. 3.

As the recesses 25, 26, 27, 28 and 29 all may be considered as opening upwardly through surface 15, the projections 24, 23, 22, 21, and 20 are respectively received therein in flush relation therewith, as being flush with the upper surface 15. Also, the end projections 20–24 are all spaced above the bed underside 16, except for a lower reinforcing portion 30 of projection 21. In conforming relation therewith, the recess 28 may open downwardly through the under surface 16 for receiving the lower portion 30 of a mating projection 21.

Certain of the projections may be provided with enhanced resilience, as by slits or cuts 35 and 36 in projections 23 and 24. That is, the cuts or slits 35 and 36 extend longitudinally inwardly into the projecting ends of projections 23 and 24, to subdivide or bifurcate the projections and define resilient tines of the projections. Also, one or more snap engagement formations or detents may be provided on certain end projections, as at 37 on projection 22, and 38 on projection 23. The detent 38 is, by the resilient nature of projection 23, resiliently deflectable for snap engagement beyond a mating detent 37 of a like track section in the interfitting track relation.

Each end edge 14 of a track section 10 is further provided with a plurality of laterally spaced additional projections, as at 40 and 41. The projections 40 and 41 are spaced below the upper bed surface 15, and may also be spaced above the lower bed surface 16. Further, the projections 40 and 41 project from and longitudinally outwardly beyond the ends of respective projections 20 and 22.

Each track section end edge 14 is further provided with a pair of additional openings, receivers or recesses for respective receiving relation with the additional projections 40 and 41 of a like track section. More particularly, each track end edge 14 is provided with a pair of laterally spaced end openings or recesses 42 and 43, which recesses are spaced below the upper bed surface 15, and spaced above the lower bed surface 16 and configured to conformably receive additional projections 40 and 41, respectively. The additional recesses or receivers 42 and 43 are provided with suitable relief openings, as at 44 and 45, say through the under surface 16, see FIG. 2.

Provided in the upper or working surface 15 of each track section 10 are a plurality of longitudinally extending, upwardly facing slots or grooves, being six (6) in number in the illustrated embodiment, and arranged in two groups of three grooves each. The outermost groove of each group is designated 50, the next adjacent or intermediate groove of each group being designated 51, and the inner groove of each group being designated 52.

The six grooves all extend longitudinally of the track section 10, in laterally spaced relation with respect to each other, and each groove opens at its opposite ends into longitudinally oppositely disposed end recesses of the bed 11. Thus, each groove 50 opens at its opposite ends into recesses 25 and 29, each groove 51 opening at its opposite ends into respective recesses 25 and 28, and each groove 52 opening at its opposite ends into longitudinally opposed recesses 26 and 28. More specifically, the grooves 50–52 have their opposite ends opening into the associated recesses, each substantially flush with the adjacent projections. The opposite ends of each groove 50 open substantially flush with respective adjacent projections 20 and 24, the opposite ends of each groove 51 opening substantially flush with respective adjacent projections 21 and 24, and each groove 52 having its opposite ends opening substantially flush with respective adjacent projections 23 and 21.

While the grooves 50–52 extend longitudinally of the track section 10, they are not quite straight, each being provided with a slightly bowed region adjacent to one end of the respective groove. Further, each bowed grooved end region is bowed laterally in the direction away from its adjacent end projection. In particular, each groove 50 is provided adjacent its end projection 24 with a bowed or curved region 55 bowed laterally in the opposite lateral direction away from associated projection 24. The grooves 51 each have the end region adjacent to respective recess 25 and projection 21 bowed outwardly, as at 56 away from the adjacent projection 21. The remaining grooves 52 each have their end region adjacent to projection 21 and recess 26 bowed outwardly, as at 57, away from the adjacent projection 21.

Received in each of the grooves 50–52 is a conductive strip or rail 60–62, which is of resilient character and resiliently deflected along the associated bowed region 55–57, without permanent deformation of the strip. That is, the conductive strips 60–62 may be substantially straight in their "at rest" or undeflected condition apart from the bed 11, and are resiliently deflectable for engagement in the respective receiving grooves 50–52 for passing along the bowed regions 55–57. However, the curvature of the bowed regions is not sufficiently great to required deflection of the received strips sufficient to cause permanent deformation. Thus, the resilient deflection of the received strips serves to frictionally retain the strips in their respective receiving grooves.

In addition, the conductive strips or rails 60–62 have their opposite end portions extending through and out of opposite open ends of the respective receiving grooves 50–52 into the adjacent end recesses. Further, by reason of the conforming curvature of strips 60–62 in the bowed groove regions 55–57, the end portions of the strips beyond the grooves extend obliquely toward the adjacent projections.

Thus, each strip 60–62, when assembled with its bed 11 in a respective receiving groove 50–52 is resiliently deflected in the bowed groove region 55–57 into a bowed strip region 65–67. The strip end portions 70, 71 and 72, extending respectively from bowed strip portions 65, 66 and 67, and being continuations of the bowed regions, extend obliquely toward their respective adjacent end projections 24 and 21. Thus, the strip end portions extending beyond the receiving grooves into an end recess are outwardly divergent or not convergent, while the strip end portions on opposite sides of each projection are outwardly convergent or not divergent, all of which insures proper interfitting relation upon end to end aligned movement toward each other of a pair of like track sections, with effective wiping action between contacting conductive strip end portions.

The track section bed 11 is further provided along opposite side edges 12 and 13 with a pair of longitudinally extending side walls, curbs or barriers 75 and 76. The side walls or barriers are generally longitudinally coextensive with the track section, so as to be continuous with the side walls or barriers of an end to end connected like track section. While the side walls or barriers 75 and 76 upstand beyond the upper or working surface 15 of the bed 11, they are cut away or provided with a downwardly facing shoulder, as at 77 and 78, spaced above the lower or supporting surface 16 of the bed. By this advantageous construction, an additional like track section, showing in phantom in FIG. 4, may be arranged in a closely nested, superposed relation with the track section shown in solid lines. Of course, a multiplicity of like track sections may also be arranged in nested relation to achieve substantial space savings in transit and shipment. Thus, it will now be appreciated that, in addition to the bed 11 of generally rectangular cross-sectional configuration, there are provided the side walls 75 and 76, also of rectangular cross sectional configuration and upstanding vertically on bed side edges 12 and 13, respectively. The rectangular, vertically upstanding side walls 75 and 76 are connected to respective bed side walls 12 and 13 with a minimum of material, consistent with requisite strength, so that the lower side wall edges 77 and 78 are remote from or considerably spaced above the bed underside 16. The recesses or concavities each formed between the underside of a respective side wall and the adjacent bed side edge are generally rectangular and essentially congruent to the configuration of a side wall upstanding beyond the bed top wall or working surface 15. That is, the recess between under surface 17 of side wall 75 and side edge 12 is congruent to the portion of side wall 75 above working surface 15. Similarly, the recess defined between the under surface 78 of side wall 76 and side edge 13 is congruent to the side wall portion above working surface 15. Thus, the recess 77, 12 and the recess 78, 13 are each adapted to substantially completely and conformably receive upstanding wall portions of a like track section, as shown in phantom in FIG. 4. In this nesting relationship, the under surface 16 of the bed 11 substantially engages with the upper bed side or working surface of the next lower track section. Further, it will be seen in the nesting relationship of FIG. 4 that the outer sides of the side walls 75 and 76 of nested track sections are vertically aligned or flush with each other, for conforming side engagement with the flush outer sides of a similar stack of track sections in nesting relation. Thus, not only do the nesting track sections of a single stack effect substantial economy in space, but further, a plurality of such stacks may be disposed in side by side relation for further maximization of economy and space. In addition, the several nesting track sections effectively reinforce and support each other against breakage, while the location of stacks in adjacent relation minimizes the possibility of shifting cargo and damage resulting therefrom.

From the foregoing, it is seen that the present invention provides a track construction for model vehicles which effects substantial savings in storage, shipment and economy in manufacture, and otherwise accomplishes its intended objects.

Although the present invention has been described in some detail by way of illustration and example for purposes of clarity of understanding, it is understood that certain changes and modifications may be made within the spirit of the invention.

What is claimed is:

1. A track section for model vehicles, said track section comprising a generally flat bed having end edges and an upper generally horizontal working surface bounded within a pair of spaced generally vertical side edges, a plurality of spaced projections on each end edge, said projections combining to define recesses in the spaces between said projections, said projections and recesses being configured for interdigitation upon end to end aligned engagement with a like track section, and a vertically upstanding wall of generally rectangular cross-section on each side edge of said bed and having its lower edge spaced above the underside of said bed to define a rectangular recess between the lower edge of each upstanding wall and the adjacent side edge of said bed, each of said recesses having a rectangular cross-sectional configuration substantially identical to the rectangular cross-sectional configuration of a respective upstanding wall above said working surface, said upstanding walls each having its upper edge spaced above said working surface a distance approximately equal to the distance the lower edge of each upstanding wall is spaced above the underside of said bed, for nesting superposed engagement with a like track section with the upstanding walls of the lower section closely and conformably entering said recesses of the upper section and the working surface of the lower section substantially engaging the underside of the upper section to define a substantially solid stack of nested sections, said stack having vertical sides defined by the outer sides of said walls for conforming side engagement of stacks in side by side relation for maximum economy of space and minimum relative shifting in storage.

* * * * *